US008317308B2

(12) United States Patent
Gold et al.

(10) Patent No.: US 8,317,308 B2
(45) Date of Patent: Nov. 27, 2012

(54) SOLID INK STICK WITH MOTION CONTROL INSET

(75) Inventors: Christopher R. Gold, Tigard, OR (US); Jonathan Ryan Ritter, Wilsonville, OR (US); Brian Walter Aznoe, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 261 days.

(21) Appl. No.: 12/835,736

(22) Filed: Jul. 14, 2010

(65) Prior Publication Data

US 2012/0013689 A1 Jan. 19, 2012

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 6,755,517 | B2 | 6/2004 | Jones et al. | |
| 6,840,613 | B2 * | 1/2005 | Jones | 347/88 |
| 7,537,326 | B2 | 5/2009 | Jones | |
| 7,726,798 | B2 | 6/2010 | Mattern et al. | |
| 2006/0279617 | A1 * | 12/2006 | Korn et al. | 347/88 |
| 2008/0117265 | A1 * | 5/2008 | Esplin et al. | 347/85 |
| 2008/0218573 | A1 * | 9/2008 | Fairchild | 347/99 |

* cited by examiner

*Primary Examiner* — Matthew Luu
*Assistant Examiner* — Rut Patel
(74) *Attorney, Agent, or Firm* — Maginot, Moore & Beck, LLP

(57) ABSTRACT

A solid ink stick for use in solid ink printers is provided that enables adjacent ink sticks to be separated and retained at a predetermined location in the feed channel.

13 Claims, 7 Drawing Sheets

SOLID INK STICK WITH MOTION CONTROL INSET

TECHNICAL FIELD

This disclosure relates generally to phase change ink printers, and in particular to solid ink sticks for use in such printers.

BACKGROUND

Phase change ink imaging products encompass a wide variety of imaging devices, such as ink jet printers, facsimile machines, copiers, and the like, that are configured to utilize phase change ink to form images on recording media. Some of these devices use phase change ink in a solid form, referred to as solid ink sticks. The ink sticks are inserted into a feed channel and abutted against each other in the channel to form a column of ink. Abutting ink sticks in a feed channel enables a substantially continuous supply of ink for use in the printer. Previously known ink stick configurations, however, have limited the ability to isolate adjacent ink sticks in the column or single out ink sticks for functional requirements, such as stick identification/authentication, feed control, ink level determination, and the like.

SUMMARY

In accordance with the present disclosure, a solid ink stick for use in solid ink printers is provided that enables adjacent ink sticks to be separated and retained at a predetermined location in the feed channel.

DETAILED DESCRIPTION

Figure 1:
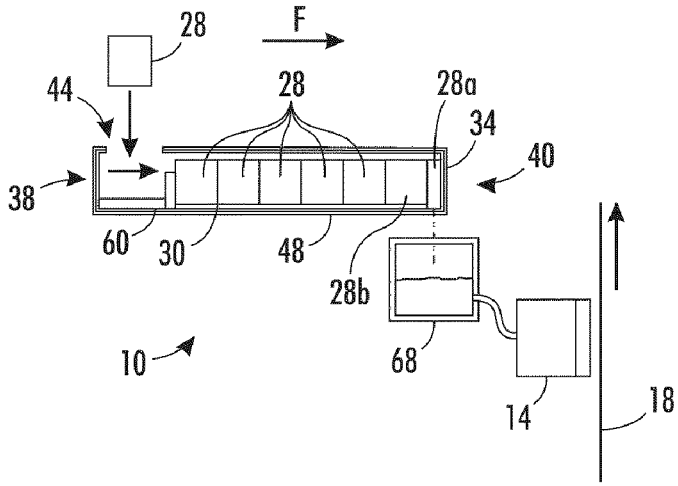
FIG. 1 is a schematic diagram of portions of a solid ink printer configured to utilize a direct printing process.

For a general understanding of the present embodiments, reference is made to the drawings. In the drawings, like reference numerals have been used throughout to designate like elements.

Figure 2:
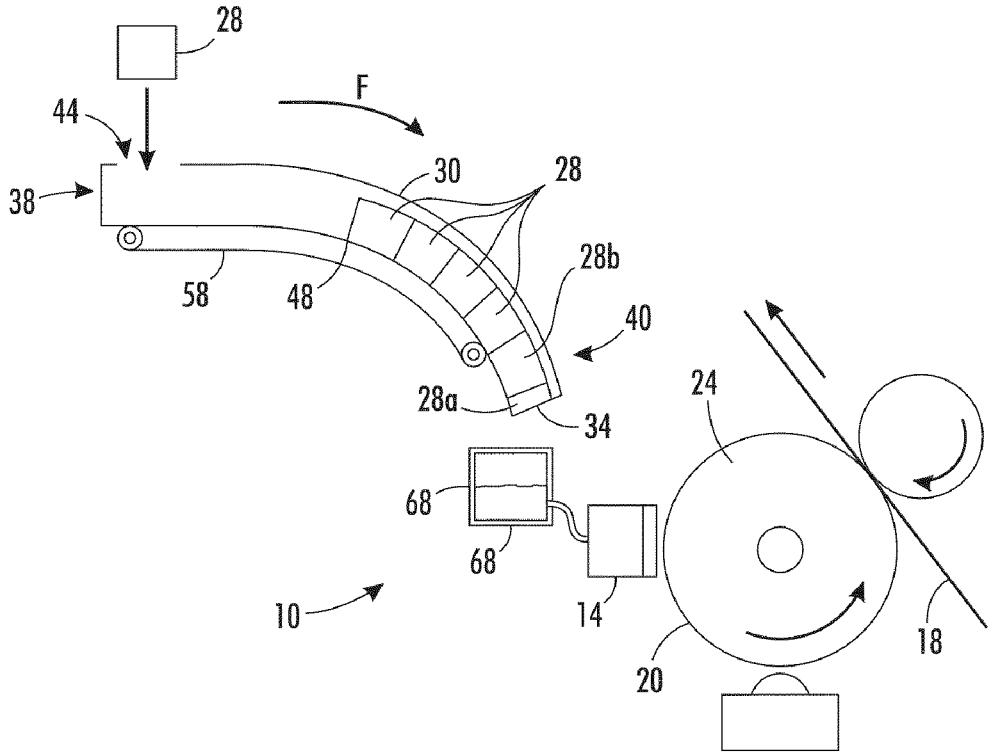
FIG. 2 is a schematic diagram of portions of a solid ink printer configured to utilize an indirect printing process.

As depicted in FIGS. 1 and 2, a phase change ink imaging device 10 includes one or more printheads 14 having ink jets configured to eject drops of liquid phase change ink to form images on the recording media 18 using either a direct (FIG. 1) or an indirect printing process (FIG. 2). In a direct printing process, the drops of ink are deposited directly onto the recording media 18 by the ink jets. In an indirect printing process, the drops of ink may be deposited onto a receiving surface 20, such as an intermediate surface, typically, comprising a layer or film of release agent applied to a moving member 24, such as a rotating drum or transport belt or band. The ink is transferred from the receiving surface 20 to the recording media 18 by bringing the recording media into contact with the receiving surface 20 (and the ink thereon) as depicted in FIG. 2. The release agent facilitates the transfer of the ink to the recording media 18 while substantially preventing the ink from adhering to the rotating member 24.

Some phase change ink imaging devices, such as the devices 10 of FIGS. 1 and 2, are configured to receive phase change ink in its solid form as blocks of ink 28, referred to as solid ink sticks. These devices, referred to herein as solid ink printers, typically have feed channels 30 for receiving solid ink sticks 28 and feeding the solid ink sticks toward a melting assembly 34 incorporated into the printer. A feed channel 30 comprises a longitudinal chute or similar type of structure having an insertion area 38 at or near one end of the channel 30 and a melt area 40 at or near the other end of the channel 30. An insertion opening 44 in the insertion area 38 enables ink sticks 28 to be sequentially loaded into the channel 30. Once inserted, the ink sticks 28 are aligned and abutted against each other in a feed path portion 48 of the channel 30 to form a substantially continuous column of solid ink that extends between the insertion area 38 and the melt area 40 of the channel 30.

The column of solid ink is moved in a feed direction F toward the melt area 40 by a mechanized delivery system and/or by gravity until the ink stick 28*a* at the leading end of the column (i.e., the end closest to the melt area) impinges on a melting device 34, such as a heated plate, located in the melt area 40 of the channel. For example, FIG. 1 depicts a mechanized delivery system that comprises a spring loaded push block 60 configured to push, or urge, ink sticks 28 toward the melt area 40 of the channel 30. FIG. 2 depicts a mechanized delivery system in the form of a conveyor belt 58 driven by pulleys for delivering ink sticks 28 to the melt area 40 of the channel. In the embodiment of FIG. 2, the feed channel 28 includes a generally vertical section 64 leading into the melt area 40 that enables gravity to provide at least a portion of the motive force for delivering ink sticks 28 to the melt area 40.

The heated plate 34 heats the impinging portion of the ink stick 28*a* to a melting temperature for the ink which melts the solid ink to a liquid ink suitable for fluid ink transport or jetting by the ink jets of the printhead(s) 14. The melted ink is directed from the heated plate to a melted ink receptacle 68, sometimes referred to as a melt reservoir, configured to maintain a quantity of the melted ink in molten form for delivery to the ink jets of the printhead as needed. As the heated plate 34 melts the ink stick 28*a* impinging on the plate, the column of ink 50 continues to be urged toward the heated plate 34 so that the next ink stick 28*b* of the column is moved into impinging contact with the heated plate 34 when the first ink stick 28*a* has been completely melted. The reservoir 68 may be associated with the printhead(s) 14 or be part of an intermediate ink delivery system (not depicted).

Figure 3A:
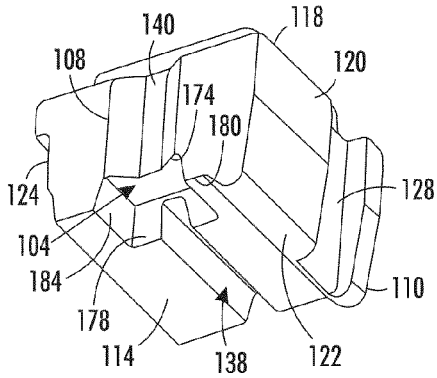
FIG. 3A is a perspective view of a solid ink stick for use with a solid ink printer, such as the printers of FIGS. 1 and 2, that has a motion control inset according to one embodiment of the present disclosure.
Figure 3B:
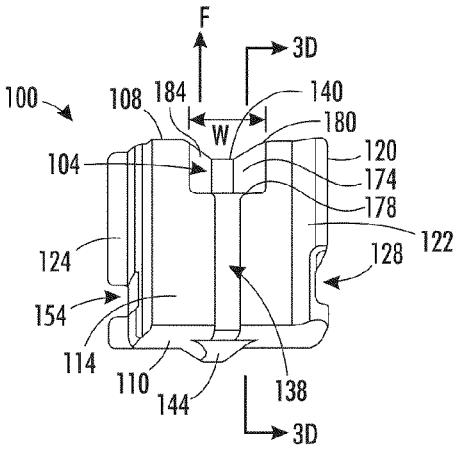
FIG. 3B is a elevational view of the bottom surface of the ink stick of FIG. 3A.
Figure 3C:
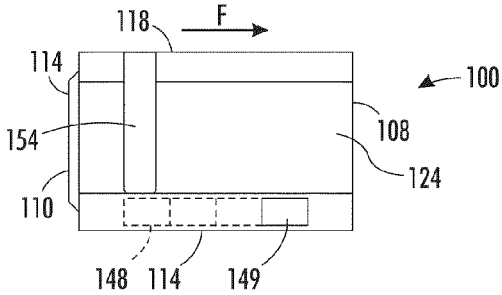
FIG. 3C is a side elevational view of the ink stick of FIG. 3.
Figure 3D:
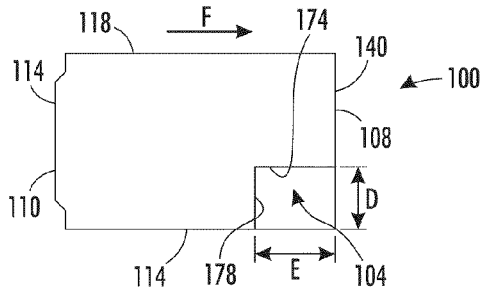
FIG. 3D is a cross-sectional view of the ink stick of FIG. 3B taken along lines 3D.

FIGS. 3A-3C illustrate an embodiment of a solid ink stick 100 for use in solid ink printers, such as the printers 10 of FIGS. 1 and 2, that includes a motion control inset 104 that enables an ink stick motion control system to be incorporated unobtrusively into the feed channels of an ink loader. The motion control inset 104 may be used by the motion control system to retain an ink stick and/or to separate adjacent ink sticks of a column of ink at one or more predetermined locations along a feed channel. The inset 104 is a recess or pocket that opens to an ink stick end. As explained below, having the ability to retain ink sticks at desired locations in a feed channel enhances the reliability of ink stick identification systems for a printer which allows incompatible ink sticks to be readily identified and removed from a feed channel prior to reaching the melting assembly of a printer.

As depicted in FIGS. 3A-3C, the solid ink stick 100 comprises a body formed of a solidified phase change ink material and shaped using a suitable fabrication process, such as casting, pour molding, injection molding, compression molding, or other known techniques. The body of the ink stick 100 of FIG. 1 includes end surfaces 108, 110, and lateral surfaces 114, 118, 120, 124. The lateral surfaces 114, 118, 120, 124 of the ink stick 100 are configured for arrangement generally parallel to the direction of ink stick travel in a feed channel, referred to herein as the feed direction F. The lateral surfaces include a bottom surface 114 configured for arrangement adjacent to the base or floor of a feed channel, a top surface 118 opposite the bottom surface, and a pair of side surfaces 120, 124 that extend between the top and bottom surfaces 118, 114. The end surfaces 108, 110 are configured for arrangement generally perpendicular to the feed direction F with end surface 108 facing in the feed direction F and serving as the leading end of the ink stick, and end surface 110 facing opposite the feed direction F and serving as the trailing end of the ink stick.

Ink sticks, such as ink stick 100 of FIGS. 3A-3C, may include a number of surface features that aid in the correct loading, guidance, feed control and support of the ink stick when used. As used herein, the term "surface features" and "features" used in relation to and ink sticks refers to topological contours, such as protrusions, recesses, grooves, and the like, that are sized, shaped, and/or otherwise configured to interact in some manner with one or more elements, devices, and members of an ink loader, or feed channel, such as key elements, guides, supports, sensors, etc. For example, the ink stick 100 includes insertion key features 128, 154 that comprise grooves or notches formed in side surface 120 and side surface 124, respectively, extending generally between the top surface 118 and the bottom surface 114. The insertion opening in the ink loader for the ink stick 100 is provided with a perimeter (not shown) shaped complementarily with respect to the perimeter shape of the ink stick 100 (best seen in FIG. 3B) having protrusions (not shown) sized, shaped, and positioned complementarily to the insertion key features 128, 154 on the stick 100.

The ink stick 100 includes feed control and guidance features for interacting with various structures provided in the feed channel. In one embodiment, ink stick 100 includes a feed key groove 138 formed in the bottom surface 114 extending from the leading end surface 108 to the trailing end surface 110. The feed key groove 138 is configured to straddle a feed key (142, FIG. 4) that extends from the feed channel. As can be seen in FIGS. 3A-3C, the feed key groove substantially intersects the motion control inset 104. The depth D of the inset 104 is greater than the depth of the feed key groove relative to the bottom surface 114 of the ink stick. In alternative embodiments, the ink stick 100 may be provided with any suitable type of feed key feature for interacting in any manner with whatever type of keying, guidance or support members are provided in a feed channel. In addition, the ink stick 100 includes guide feature 122 near the ink stick side surface 120 for interacting with a complementary structure in the feed channel to facilitate alignment of ink sticks in the channel and to limit contact between ink sticks and the feed channel structural elements, such as ribs, supports and other potentially restrictive surfaces.

The ink stick 100 also includes nesting features 140, 144 at the leading and trailing ends of the ink stick that enable adjacent ink sticks in the feed channel to interlock to further promote alignment of ink sticks as well as to maximize load density in the feed channel. The nesting features 140, 144 comprise complementarily configured topological features at the ends of the stick. In the embodiment of FIGS. 3A-3C, the nesting feature 140 comprises a protrusion having a predetermined shape, size, and position in the leading surface 108 of the stick. The nesting feature 144 comprises a recess or groove in the trailing surface 110 that is sized, shaped, and positioned complementarily with respect to the nesting feature 140. Of course, in alternative embodiments, the positions of the protruding and recessed nesting features on the ink stick may be reversed. In use, when an ink stick having a nesting feature 140 in the leading surface 108 abuts an ink stick in the feed channel having complementary nesting feature 144 in the trailing surface 110, the protruding nesting feature 140 of the ink stick is received in the recessed nesting feature 144 of the subsequent stick as depicted with the two ink sticks 100 to the right in FIG. 4. The nesting features of the adjacent sticks cooperate to limit lateral movement of the sticks with respect to each other thereby promoting alignment of the sticks in the channel.

In addition to or as an alternative to the insertion, feed guidance, and nesting features, ink sticks may be provided with sensor features for conveying ink stick data to the print controller of the solid ink printer. The ink stick data encoded onto an ink stick may include identification information, such as color, formulation, and intended printer model, as well as printing information, such as printer settings or preferences for use with the ink stick. Sensor features comprise surface formations on the ink stick body that are configured to interact with sensors positioned at one or more locations in the insertion region and/or other portions of feed channels to convey ink stick data to the print controller of a solid ink printer.

Sensor features may have any suitable configuration that permits reliable sensor interaction, such as protrusions, recesses, reflective features, non-reflective features, and the like, depending on the type of sensor used. In the embodiment of FIGS. 3A-3C, the ink stick 100 includes a sensor feature 148 that comprises one or more contiguous insets 149 arrayed in the feed direction F in a lower portion of the side surface 124. A single inset 149 is shown in FIG. 3C. The dotted lines represent other positions where insets may be placed in the exemplary embodiment.

Figure 4:
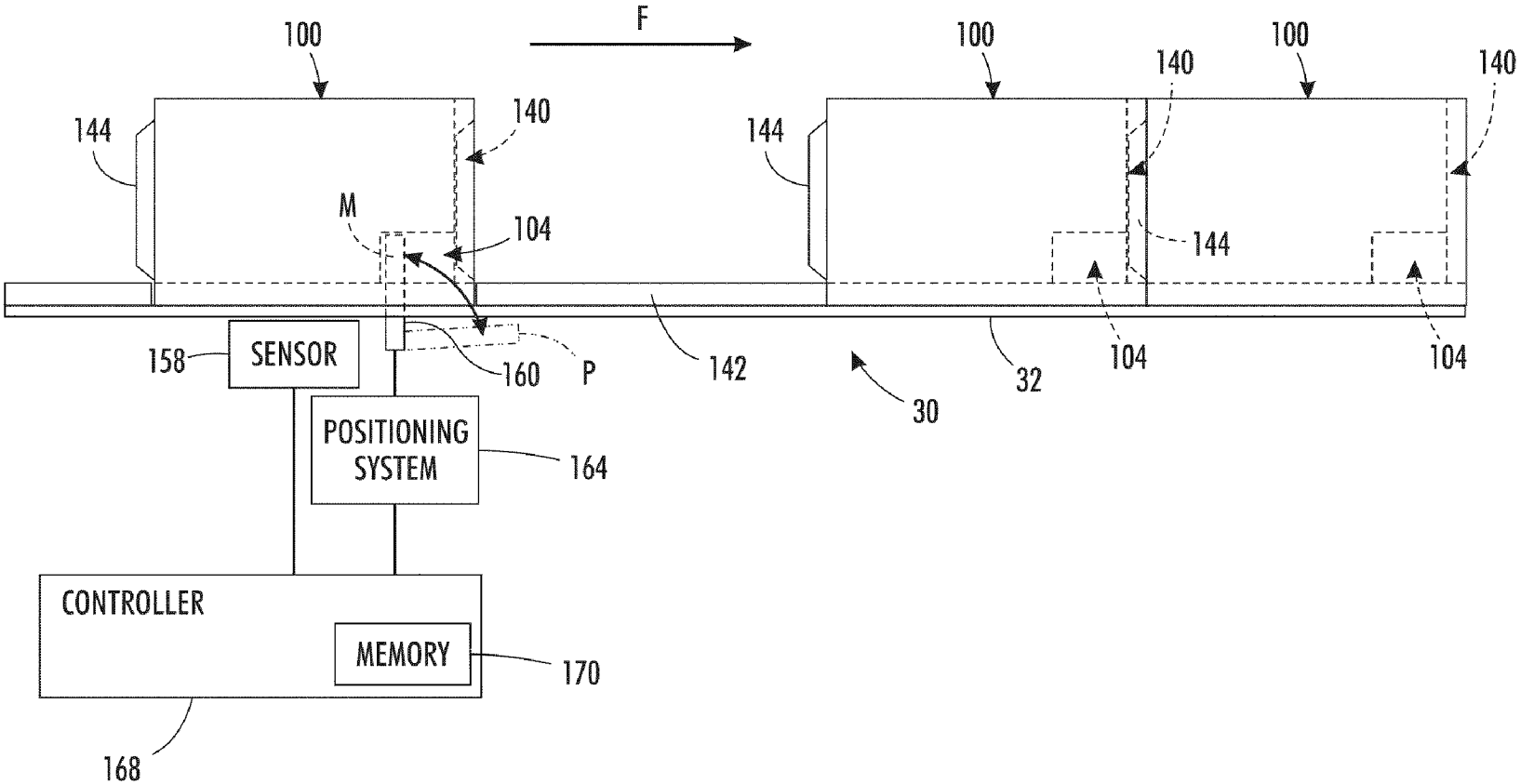
FIG. 4 is schematic diagram of an embodiment of a feed channel including a gate for interfacing with the motion control inset of the ink stick of FIG. 3.

Ink stick data may be encoded into a sensor feature 148 of an ink stick by assigning data to the sensor feature 148. Referring to FIG. 4, to extract the data from the sensor feature 148, the feed channel 30 is provided with a sensor system 158 capable of sensing, detecting, or being actuated by the recesses 149 of the sensor feature 148. The sensor feature actuates the sensors of the sensor system 158 causing the sensor system to output signals to the printer controller 168 indicative of the data assigned to the sensor feature 148. The controller 168 may then use the data to influence operations of the printer. For example, in one embodiment, once the ink stick data has been identified, the controller 168 may determine whether or not the ink stick is compatible with the printer and enable or disable operations accordingly.

To facilitate reliable interaction between the sensor feature 148 of an ink stick and the sensor system 158 in a feed channel, the ink stick 100 is provided with a motion control inset 104. With reference to FIGS. 3A-3D and FIG. 4, the motion control inset 104 comprises a recess or pocket formed in the ink stick 100 that is configured to provide clearance for a gate, stop, or similar type of structure, referred to hereafter as gate 160, to be moved into engagement with an inner surface of the inset 104 to prevent further movement of the ink stick toward the melt area of the channel 30.

As seen in FIG. 4, the gate 160 is located at or below the bottom wall or floor 32 of the feed channel 30 at a suitable location between the insertion area and the melt area of the channel. The gate 160 is operably coupled to a suitable positioning system 164 that enables the gate 160 to be moved between a clear position P in which the gate 160 is positioned substantially below the ink stick and an elevated position M in which the gate 160 is extended upwardly into the feed path of the ink sticks in the feed channel. In the exemplary embodiment, the gate 160 is configured for pivotal movement between the clear position P and the elevated position M although any suitable type of movement into and out of the feed channel 30, including axial movement, pivotal movement, and rotational movement, may be used.

The inset 104 may be of any suitable configuration. For example, the inset 104 may have a predominantly squared off shape, be semicircular or triangular, as example. In the embodiment of FIGS. 3A-3C, the motion control inset 104 comprises a recess or pocket formed at the junction between the leading surface 108 and the bottom surface 114 intermediate to the side surfaces 120, 124. The inset 104 is defined by an upper interior surface 174, an interior indented surface 178, and lateral interior surfaces 180, 184. The upper interior surface 174 is recessed from the bottom surface 114 a distance D that corresponds to the depth of the inset. The interior indented surface 178 is recessed from the leading surface 108 of the ink stick by a distance E that corresponds to the extension of the inset 104 from the leading surface 108 toward the trailing surface 110. The lateral interior surfaces 180, 184 are spaced apart by a distance W that corresponds to the width of the inset 104. The interior surfaces of the inset cooperate to define a clearance area in front of the indented surface 178 through which the gate 160 may be moved as it travels toward the indented surface. As used herein, the term "clearance area" refers to the open space or void that the indented surface creates between ink sticks abutted end to end. FIGS. 3A-3D and 4 depict an ink stick having an inset in the trailing end of the ink stick body. In alternative embodiments, as explained below, an inset may be produced at the trailing end or both ends.

Figure 5A:
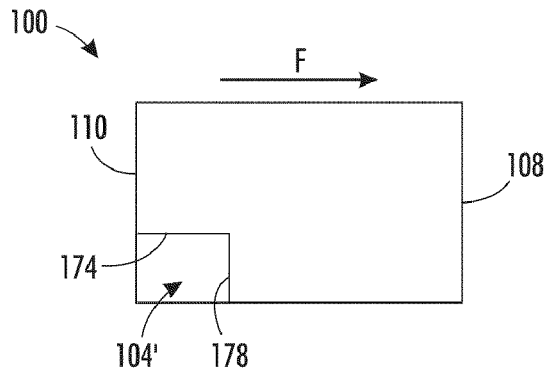
FIG. 5A is a side view of an ink stick having a motion control inset in a trailing end of the ink stick.
Figure 5B:
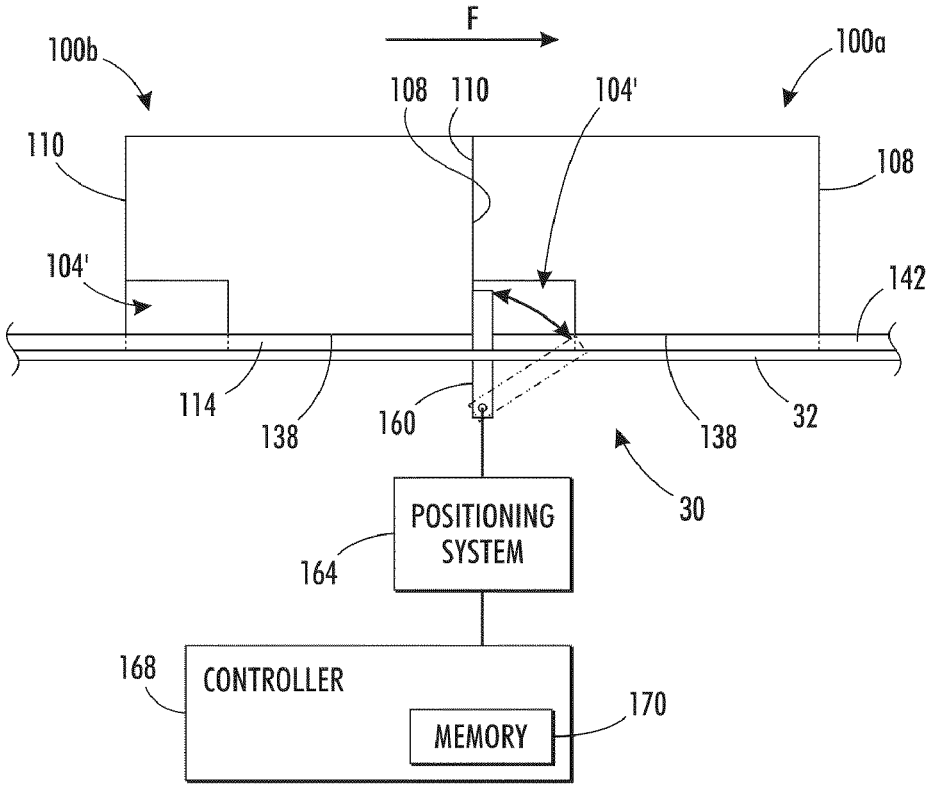
FIG. 5B is a side view of two ink sticks having trailing end insets abutted in a feed channel.

The indented surface is oriented at least partially perpendicular to the feed direction F. The dimensions D, E, and W of the inset 104 are selected to provide clearance for the gate 160 to be moved into the inset. Depending on placement of the at least one inset, further movement of the ink stick or the column of ink in the feed channel causes the gate to contact the indented surface if the inset is formed at the leading end of the ink stick (FIGS. 3A-3D, 4, 6A, and 6B), or causes the gate to contact a leading surface of a following stick if the inset is provided in the trailing end of the ink stick (FIGS. 5A and 5B). Thus, when the gate 160 is moved into the elevated position into the clearance area of an ink stick, further movement of that ink stick or the subsequent ink stick in the feed direction F is substantially prevented. Any suitable distances for the dimensions D, E, and W may be used that is compatible with the configuration and movement style of the gate 160. In one single end inset embodiment, the depth D of the recess is approximately 6.5 mm, the width W is approximately 15 mm, and the extensions E is approximately 10 mm. The description of the gate 160 being elevated into the clearance area of an ink stick is intended to reflect the condition that exists when an ink stick is in the feed path just forward of an inserted ink stick. When the inset is placed at the rear of the ink stick and no stick would be abutted or nearly abutted to the inserted stick, the gate may not actually be in a recess but may instead be just ahead of the corresponding ink stick frontal interface area.

Figure 3E:
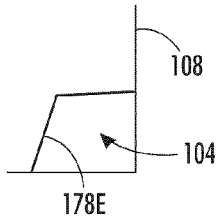
FIGS. 3E-3G depict different configurations of the indented surface of a motion control inset that may be incorporated into the ink stick of FIG. 3.
Figure 3F:
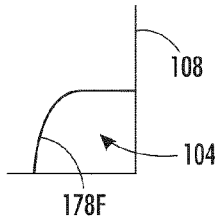
Figure 3G:
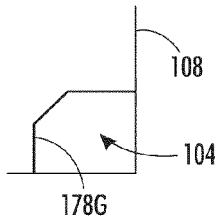

The inset indented surface 178 may have any suitable configuration for interacting with the gate 160 to prevent or impede forward motion of the ink stick depending on the shape of the gate which may in turn be influenced in part on reliable engagement and disengagement with the ink stick. For example, in the embodiment of FIGS. 3A-3D and 4, the indented surface 178 is oriented substantially perpendicular to the feed direction F. FIGS. 3E-3G depict examples of some other possible configurations for the indented surface 178. As depicted, the indented surface 178 may be somewhat perpendicular to the feed direction F including angled surfaces 178E (FIG. 3E), rounded surfaces 178F (FIG. 3F), and multiple surfaces at various angles 178G (FIG. 3G).

A gate 160 may be located at any suitable position or multiple positions in the channel 30 for retaining ink sticks or separating adjacent ink sticks in a column of ink. The column of ink may be oriented horizontally, vertically or any other constant or varying angle or contour. The controller 168 is operably coupled to the positioning system 164 to control the activation and deactivation of the gate 160 in order to exert feed influence or position control over ink sticks under various conditions. For example, in the embodiment of FIG. 4, the gate 160 is positioned proximate the insertion area 38 of the feed channel 30 in order to retain ink sticks as they are inserted into the channel to allow the sensor system 158 to read the data embedded into the sensor feature 158. The data is output to the controller 168 which makes a determination as to whether the ink stick is compatible with the printer.

If the data indicates that the ink stick 100 is compatible with the printer, the controller causes the gate 160 to move to the clear position P via the positioning system 164 so that the ink stick 100 may be advanced in the feed direction F toward the melt area of the channel. The gate 160 may then be activated to retain the next ink stick in the feed channel for identification. If the data indicates that the ink stick 100 is not compatible with the printer, the controller 168 maintains the gate in engagement with the inset 104 to prevent the incompatible ink stick from being advanced. The controller 168 may then issue a suitable alert or message for the operator of the device indicating that an incompatible ink stick has been installed and needs to be removed.

FIGS. 5A and 5B depict alternative embodiment of a motion control inset 104' for use with ink sticks. In the embodiment of FIG. 5, the inset 104' is positioned opposite from the inset 104 of FIGS. 3A-3C. As depicted, the inset 104' comprises a recess formed at the junction between the bottom surface 114 and the trailing surface 110 trailing end 110 of the ink sticks 100. In this embodiment, the inset 104' of the leading ink stick 100*a* in a feed channel 30 is configured to provide clearance for the gate 160 to be moved into the inset and into contact with the leading surface 108 of the next ink stick 100*b* in the channel. In this implementation, the gate may not even have to contact an interior surface of an inset 104'.

Figure 6A:
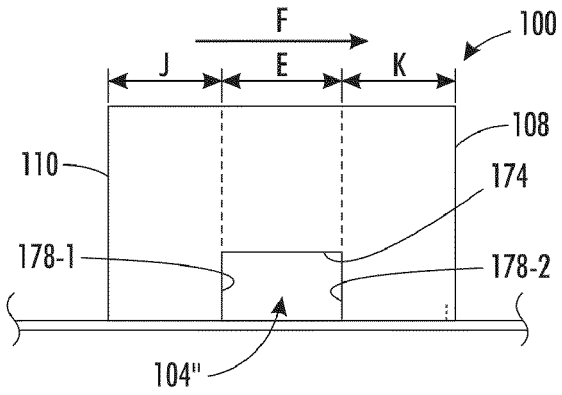
FIG. 6A is a side view of an ink stick having a motion control inset in an intermediate region between the leading and trailing ends of the ink stick.
Figure 6B:
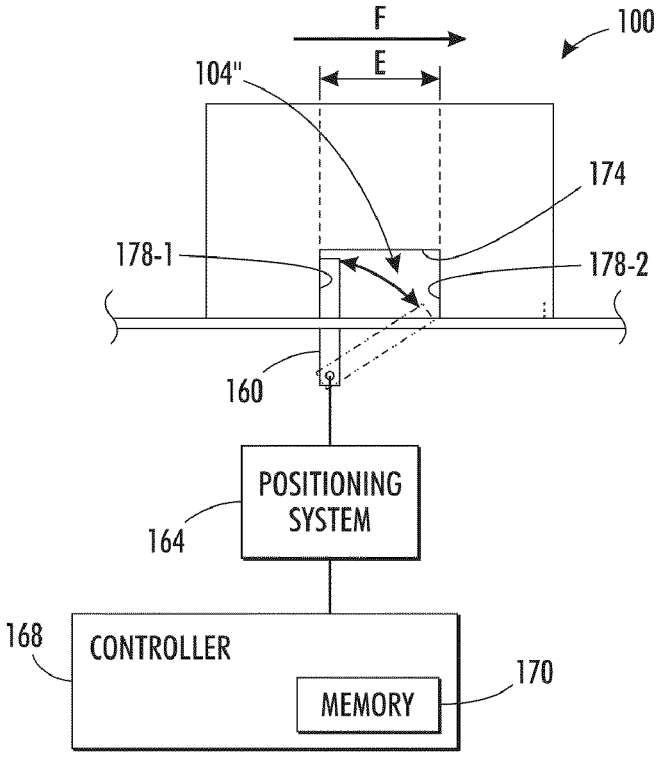
FIG. 6B is a side view of the ink stick of FIG. 6A in a feed channel.

FIGS. 6A and 6B depict an embodiment of an ink stick 100 having an inset 104" that is located in an intermediate region of the ink stick between the leading and trailing ends 108, 110. The inset 104" is defined by a leading indented surface 178-2, a trailing indented surface 178-1, and an upper interior surface. The inset 104" may be positioned intermediate the lateral side surfaces 120, 124 (not shown in FIGS. 6A and 6B). In some cases, the inset 104" may extend through one or more of the side surfaces 120, 124. The indented surfaces 178-1, 178-2 are spaced apart a distance E by upper interior surface 174 to define a clearance area for the gate 160 to be moved into the elevated position in the feed channel. As depicted in FIG. 6A, the trailing indented surface 178-1 is positioned a distance J from the trailing end 110, and the leading indented surface 178-2 is positioned a distance K from the leading surface. The dimensions J and K may have any suitable value for positioning the inset 104" at a desired location relative to the leading and trailing ends 108, 110.

Figure 7A:
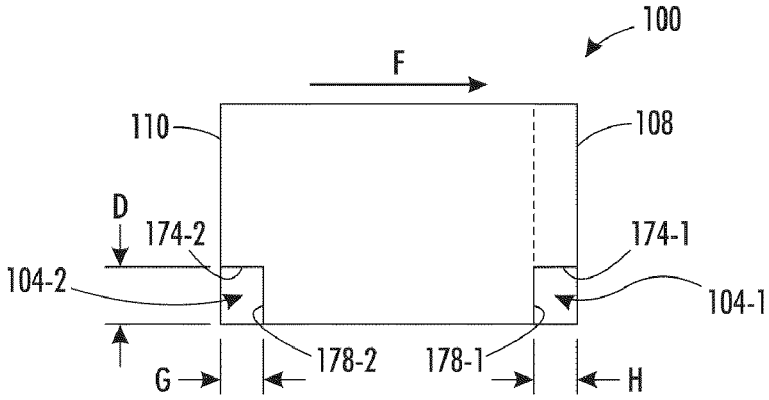
FIG. 7A is a side view of an ink stick having a motion control inset in both the leading and trailing ends of the ink stick.
Figure 7B:
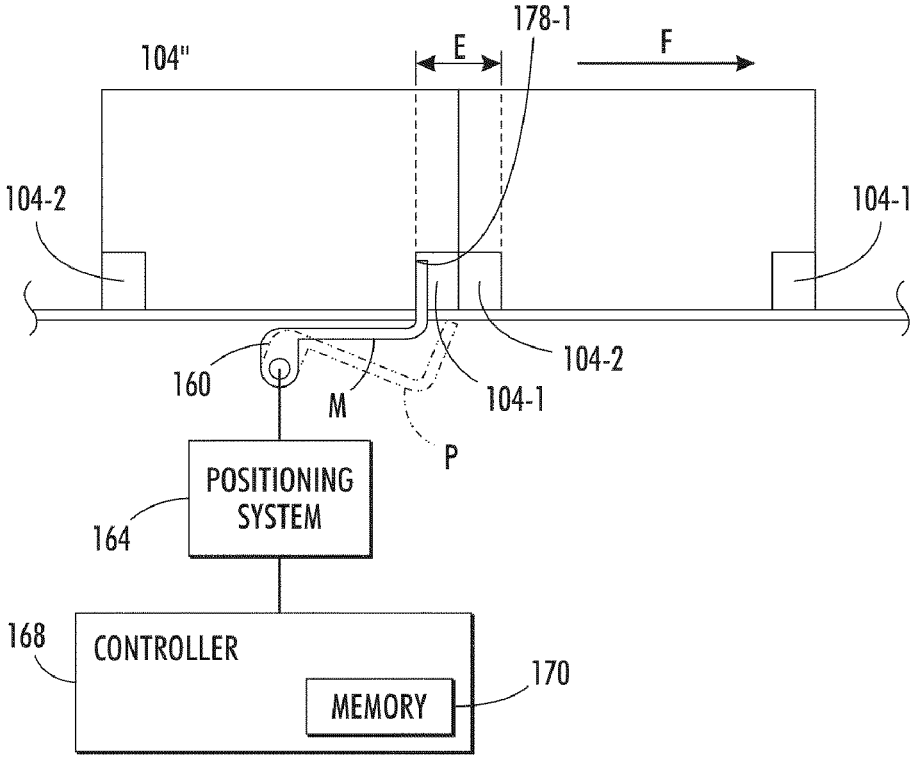
FIG. 7B is a side view of two ink sticks having leading end and trailing end insets abutted in a feed channel.

FIGS. 7A and 7B depict an embodiment in which the inset comprises a leading end inset portion 104-1 and a trailing end inset portion 104-2. The leading end inset portion 104-1 are each defined by a corresponding upper interior surface 174-1, 174-2, an interior indented surface 178-1, 178-2. The upper interior surfaces 174-1, 174-2 are recessed from the bottom surface 114 a distance D. The interior indented surface 178-1 is recessed from the leading surface 108 of the ink stick by a distance H, and the interior indented surface 178-2 is recessed from the trailing surface 110. As seen in FIG. 7B, when two ink sticks are abutted, the leading end inset portion 104-1 of the trailing ink stick and the trailing end inset portion 104-2 of the leading ink stick form a contiguous inset having a combined dimension E that provides a clearance area for the gate 160 to be moved into the elevated position M so as to be interposed between the ink sticks. The dimensions G and H of the trailing end and leading end inset portions may be the same or different from each other to arrive at the combined dimension D.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. A solid ink stick for use in solid ink printers, the ink stick comprising:

an ink stick body having a leading end, a trailing end opposite the leading end, a bottom surface extending between the leading end and trailing ends on one side of the ink stick body, a top surface extending between the leading end and trailing end opposite the bottom surface, and a pair of opposed lateral side surfaces that extend between the leading end and the trailing end and between the top surface and the bottom surface; and at least one inset formed in the bottom surface intermediate the lateral side surfaces, the inset including:

an interior indented surface recessed a first predetermined distance from the trailing end or the leading end of the ink stick, the first predetermined distance being less than a length of the ink stick from the leading end to the trailing end and the interior indented surface being oriented at least somewhat perpendicular to a feed direction;

at least two lateral interior surfaces that are separated by a second predetermined distance that is less than a width of the ink stick between the opposed lateral side surfaces of the ink stick; and an upper interior surface recessed a third predetermined distance from the bottom surface, the third predetermined distance being less than a height of the ink stick from the bottom surface to the to surface, the upper interior surface, the at least two lateral interior surfaces, and the interior indented surface cooperating to define a clearance area within the ink stick that is configured to receive a movable gate and impede movement of the ink stick in the feed direction.

2. The ink stick of claim 1, further comprising:

a sensor feature formed in at least one of the lateral side surfaces of the ink stick body, the sensor feature being encoded with ink stick data pertaining to the ink stick body.

3. The ink stick of claim 2, further comprising:

an insertion key feature formed in at least one of the lateral side surfaces extending between the top surface and the bottom surface.

4. The ink stick of claim 2, further comprising:

a feed key groove formed in the bottom surface extending between the interior indented surface to the leading end or the trailing end of the ink stick from which the interior indented surface is not recessed, the feed key groove having a width that is less than the second predetermined distance between the at least two lateral interior surfaces of the inset.

5. The ink stick of claim 4, the third predetermined distance being greater than a depth of the feed key groove relative to the bottom surface of the ink stick.

6. The ink stick of claim 2, further comprising:

a first nesting feature located on the leading end of the ink stick body, and a second nesting feature located on the trailing end of the ink stick body, the second nesting feature being complementarily configured with respect to the first nesting feature.

7. The ink stick of claim 2, the sensor feature being configured to interact with a sensor system in a feed channel to convey the ink stick data to a printer control system.

8. A method of using a phase change ink imaging device, the method comprising:

inserting an ink stick into an insertion region of an ink loader, the ink stick having a leading end, a trailing end opposite the leading end, a bottom surface extending between the leading end and trailing ends on one side of the ink stick body, a top surface extending between the leading end and trailing end opposite the bottom surface, a pair of opposed lateral side surfaces that extend between the leading end and the trailing end and between the top surface and the bottom surface, and an inset formed in the bottom surface of the ink stick that extends inwardly from at least one of the leading end and the trailing end of the ink stick, the inset enables a gate to extend into a clearance area within the inset, the clearance area being between an ink stick in the insertion region and an abutted adjacent ink stick in a portion of a feed channel adjacent the insertion region, the ink stick being inserted with the bottom surface facing a base of the feed channel and the leading end facing in a feed direction through the feed channel;

moving a gate from below the ink stick in the feed channel into an elevated position to contact a surface of the ink stick within the inset that is intermediate the lateral side surfaces, the gate inhibiting movement of the ink stick in the feed direction;

retracting the gate and moving the inserted ink stick from the insertion region;

moving the gate into the feed path as the inserted stick moves past the insertion region;

inserting a second ink stick into the insertion region; and restraining movement of the second ink stick with the gate prior to determining the second ink stick is a compatible ink stick.

9. The method of claim 8, further comprising:

detecting a sensor feature formed in one of the surfaces of the ink stick to identify ink stick data encoded into the sensor feature with the ink stick retained by the gate.

10. The method of claim 9, further comprising:

determining whether the ink stick is compatible with the feed channel, the compatibility of the ink stick with the feed channel being determined with reference to the ink stick data encoded in the sensor feature.

11. The method of claim 10, further comprising:

removing the gate from the ink stick feed path in response to the ink stick being determined as being compatible with the feed channel.

12. The method of claim 8, further comprising:

engaging a guide feature of the ink stick with a guide rail in the feed channel, the guide feature being formed in the bottom surface of the ink stick and extending between the leading end and the trailing end of the second ink stick.

13. The method of claim 8, further comprising:

engaging a feed key groove of the ink stick with a channel feed key, the feed key groove extending between the inset in the second ink stick and the other of the leading end and the trailing end of the second ink stick.

* * * * *